US006489736B1

(12) United States Patent
Ueno et al.

(10) Patent No.: US 6,489,736 B1
(45) Date of Patent: Dec. 3, 2002

(54) COLOR CATHODE RAY TUBE APPARATUS

(75) Inventors: Hirofumi Ueno, Fukaya (JP); Kazunori Satou, Fukaya (JP); Tsutomu Takekawa, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/646,102

(22) PCT Filed: Jan. 25, 2000

(86) PCT No.: PCT/JP00/00358

§ 371 (c)(1),
(2), (4) Date: Sep. 21, 2000

(87) PCT Pub. No.: WO00/45414

PCT Pub. Date: Aug. 3, 2000

(30) Foreign Application Priority Data

Jan. 26, 1999 (JP) ..... 11-016902
Feb. 10, 1999 (JP) ..... 11-032259
Nov. 17, 1999 (JP) ..... 11-326597

(51) Int. Cl.[7] ..... H01J 29/46; H01J 29/50
(52) U.S. Cl. ..... 315/382; 315/15; 313/412
(58) Field of Search ..... 315/15, 382, 368.15, 315/17, 382.1, 368.16, 368.11, 364, 370; 313/421, 413, 441, 449, 412

(56) References Cited

U.S. PATENT DOCUMENTS 5,113,112 A * 5/1992 Shimoma et al. ..... 313/412
5,262,702 A * 11/1993 Shimoma et al. ..... 313/414
5,339,010 A * 8/1994 Urata et al. ..... 315/368.17
5,694,004 A * 12/1997 Kimiya et al. ..... 313/412
5,744,917 A * 4/1998 Kawaharada ..... 313/414
6,031,346 A * 2/2000 Shirai et al. ..... 313/414
6,339,293 B1 * 1/2001 Kimiya et al. ..... 313/421
6,225,766 B1 * 5/2001 Ono et al. ..... 313/414
6,236,152 B1 * 5/2001 Kimiya et al. ..... 313/412

FOREIGN PATENT DOCUMENTS

| | | |
|---|---|---|
| EP | 0 714 115 | 5/1996 |
| JP | 64-38947 | 2/1989 |
| JP | 10-92332 | 4/1998 |

* cited by examiner

*Primary Examiner*—Don Wong
*Assistant Examiner*—Chuc Tran

(57) ABSTRACT

An electron gun assembly has at least one additional electrode located along the equipotential plane of a potential distribution formed between a focusing electrode and anode electrode forming a main lens. In a no-deflection state, the additional electrode receives a voltage of a predetermined level corresponding to the potential of the equipotential plane on which the additional electrode is located. In a deflection state, letting Vf be the application voltage of the focusing electrode, Eb be the application voltage of the anode electrode, and Vs be the application voltage of the addition electrode, a value (Vs−Vf)/(Eb−Vf) changes with an increase in electron beam deflection amount, while the additional electrode forms an electron lens having different focusing powers in the horizontal direction and vertical direction.

14 Claims, 10 Drawing Sheets

COLOR CATHODE RAY TUBE APPARATUS

TECHNICAL FIELD

The present invention relates to a color cathode ray tube apparatus and, more particularly, to a color cathode ray tube apparatus for reducing the elliptic distortion of a beam spot at the periphery of a screen and displaying a high-quality image.

BACKGROUND ART

A color cathode ray tube apparatus has an envelope made up of a panel and funnel. The funnel incorporates in its neck an electron gun assembly for emitting three electron beams, i.e., a center beam and a pair of side beams that pass through the same horizontal plane. A deflection yoke for forming a nonuniform magnetic field for deflecting the three electron beams is mounted on the funnel. The nonuniform magnetic field is formed from a pincushion type horizontal deflection magnetic field and barrel type vertical deflection magnetic field.

Three electron beams emitted by the electron gun assembly are focused on a phosphor screen while being converged to the entire surface of the phosphor screen formed on the inner surface of the panel through a shadow mask by the nonuniform magnetic field. Then, a color image is displayed.

The color cathode ray tube apparatus adopts, e.g., a BPF (Bi-Potential Focus) DAC&F (Dynamic Astigmatism Correction and Focus) type electron gun assembly.

As shown in FIG. 1, this electron gun assembly has three cathodes K aligned in a line, and a first grid G1, second grid G2, third grid G3 made up of a first segment G31 and second segment G32, and fourth grid G4 which are sequentially laid out in a tube axis direction from the cathode K to the phosphor screen. Each grid has three electron beam apertures formed in correspondence with the three cathodes K.

In the electron gun assembly, the cathode K receives a voltage prepared by superposing a video signal on a reference voltage of 150 V. The first grid G1 is grounded, and the second grid G2 receives a voltage of about 600 V. The first segment G31 of the third grid G3 receives a voltage of about 6 kV, and the second segment G32 thereof receives a variable voltage prepared by superposing a parabolic voltage on a reference voltage of about 6 kV. This parabolic voltage increases with an increase in electron beam deflection amount, and maximizes for the maximum deflection amount, i.e., in deflecting an electron beam to the corner of the phosphor screen. The fourth grid G4 receives a voltage of about 26 kV.

The cathodes K, first grid G1, and second grid G2 constitute an electron beam generator for generating an electron beam and forming an object point with respect to a main lens (to be described later). The second grid G2 and the first segment G31 of the third grid G3 constitute a pre-focusing lens for preliminarily focusing the generated electron beam. The second segment G32 of the third grid G3 and the fourth grid G4 constitute a BPF type main lens for finally accelerating and focusing the preliminarily focused electron beam on the phosphor screen.

When the electron beam is deflected to the corner of the phosphor screen, the potential difference between the second segment G32 and fourth grid G4 minimizes to minimize the power of the main lens. At the same time, the maximum potential difference occurs between the first and second segments G31 and G32 to form a quadrupole lens for horizontally focusing an electron beam and vertically diverging it. The power of the quadrupole lens at that time is maximum.

When the electron beam is deflected to the corner of the phosphor screen, the distance from the electron gun assembly to the phosphor screen becomes maximum, and the distance from the object point to the image point becomes longer. An increase in distance from the object point to the image point is compensated by weakening the power of the main lens. The deflection aberration of the nonuniform magnetic field formed by the deflection yoke is compensated by the action of a quadrupole lens formed between the first and second segments G31 and G32.

To improve the image quality of the color cathode ray tube apparatus, the focusing characteristic and beam spot shape on the phosphor screen must be improved. Particularly in an in-line type color cathode ray tube apparatus for emitting three electron beams in a line, a beam spot 1 at the center of the screen can be made circular, as shown in FIG. 2. However, a beam spot 1 at the periphery extending from the end of the horizontal axis (X-axis) to the end of the diagonal axis (D-axis) elliptically distorts (vertically collapses) and causes a blur 2 owing to the deflection aberration.

The blur 2 of the beam spot 1 can be eliminated, as shown in FIG. 3, by adopting the DAC&F method of dividing a low-voltage electrode forming a main lens into a plurality of segments, like the third grid G3 of the electron gun assembly. However, the elliptic distortion of the beam spot 1 at the periphery of the screen cannot be eliminated. This elliptic distortion interferes with the electron beam aperture of the shadow mask to generate moire, which makes it difficult to see the display contents.

The vertical collapse of the beam spot 1 at the periphery will be explained with reference to optical models shown in FIGS. 4 and 5. In a no-deflection state in which an electron beam is focused on the center of the screen, an electron beam 8 generated by the electron beam generator is preliminarily focused by a pre-focusing lens, and focused on a phosphor screen 5 by a main lens 4. In a deflection state in which an electron beam is deflected to the periphery of the phosphor screen, the electron beam 8 is preliminarily focused by the pre-focusing lens, passes through a quadrupole lens 6, and deflected by a deflection magnetic field 7 having a quadrupole component while being focused on the phosphor screen 5 by the main lens 4. Then, the electron beam 8 is focused on the phosphor screen 5.

In general, the beam spot size on the screen depends on a magnification M. The magnification M is given by the ratio $\alpha 0/\alpha i$ of a divergent angle $\alpha 0$ and incident angle $\alpha i$ of the electron beams 8. Letting Mh be the horizontal magnification, Mv be the vertical magnification, $\alpha 0h$ be the horizontal divergent angle, $\alpha ih$ be the horizontal incident angle, $\alpha 0v$ be the vertical divergent angle, and $\alpha iv$ be the vertical incident angle, the horizontal and vertical magnifications Mh and Mv are given by $$Mh=\alpha 0h/\alpha ih$$

$$Mv=\alpha 0h/\alpha iv$$

If $$\alpha 0h=\alpha 0v$$

the above components satisfy $$\alpha ih=\alpha iv$$

$$Mh=Mv$$

in the no-deflection state shown in FIG. 4.

The beam spot at the center of the screen becomes circular. To the contrary, in the deflection state shown in FIG. 5, the above components change to $$\alpha ih<\alpha iv$$

$$Mh>Mv.$$

The beam spot extends along the D-axis at the periphery.

As described above, to improve the image quality of the color cathode ray tube apparatus, the focusing characteristic and beam spot shape on the phosphor screen must be improved.

As for the focusing characteristic and beam spot shape, the conventional BPF DAC&F type electron gun assembly changes the power of the main lens along with changes in electron beam deflection amount. In addition, the electron gun assembly forms a dynamically changing quadrupole lens to eliminate any vertical blur of the beam spot caused by the deflection aberration and focus the electron beam on the entire screen.

However, the elliptic distortion of the beam spot at the periphery cannot be eliminated. This elliptic distortion may interfere with the electron beam apertures of the shadow mask to generate moire, degrading the display quality.

DISCLOSURE OF INVENTION

The present invention has been made to overcome the conventional drawbacks, and has as its object to provide a color cathode ray tube apparatus for reducing the elliptic distortion of a beam spot on the entire screen and displaying a high-quality image.

According to the present invention, there is provided a color cathode ray tube apparatus comprising an electron gun assembly having a main lens which is made up of at least a focusing electrode and anode electrode, and accelerates and focuses an electron beam on a phosphor screen, and a deflection yoke for generating a deflection magnetic field for deflecting the electron beam emitted by the electron gun assembly, wherein the electron gun assembly has at least one additional electrode located along an equipotential plane of a potential distribution formed between the focusing electrode and anode electrode forming the main lens, in a no-deflection state in which the electron beam is focused on a center of the phosphor screen, the additional electrode receives a voltage of a predetermined level corresponding to a potential of the equipotential plane on which the additional electrode is located, and in a deflection state in which the electron beam is deflected to a periphery of the phosphor screen, letting Vf be an application voltage of the focusing electrode, Eb be an application voltage of the anode electrode, and Vs be an application voltage of the additional electrode, a value $$(Vs-Vf)/(Eb-Vf)$$

changes with an increase in electron beam deflection amount, while the additional electrode forms an electron lens having different horizontal and vertical focusing powers.

According to the present invention, there is provided a color cathode ray tube apparatus comprising an electron gun assembly having a main lens which is made up of at least a focusing electrode and anode electrode, and accelerates and focuses an electron beam on a phosphor screen, and a deflection yoke for generating a deflection magnetic field for deflecting the electron beam emitted by the electron gun assembly, wherein the electron gun assembly has at least one additional electrode located along an equipotential plane of a potential distribution formed between the focusing electrode and anode electrode forming the main lens, in a predetermined deflection state in which the electron beam is deflected, the additional electrode receives a voltage of a predetermined level corresponding to a potential of the equipotential plane on which the additional electrode is located, and in a deflection state in which the electron beam is deflected to a periphery of the phosphor screen, letting Vf be an application voltage of the focusing electrode, Eb be an application voltage of the anode electrode, and Vs be an application voltage of the additional electrode, a value $$(Vs-Vf)/(Eb-Vf)$$

changes with an increase in electron beam deflection amount, while the additional electrode forms an electron lens having different horizontal and vertical focusing powers.

BEST MODE FOR CARRYING OUT THE INVENTION

Embodiments of a color cathode ray tube apparatus according to the present invention will be described in detail below with reference to the several views of the accompanying drawing.

Figure 6:
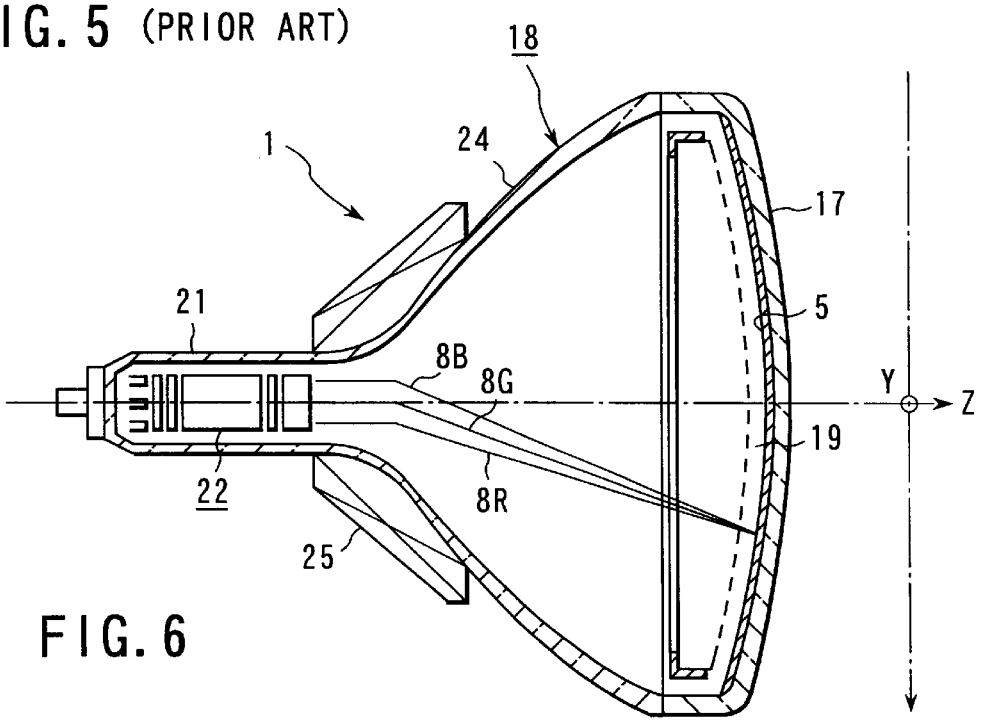
FIG. 6 is a sectional view showing the arrangement of a color cathode ray tube apparatus according to the present invention.

As shown in FIG. 6, a color cathode ray tube apparatus 1 has an envelope made up of a panel 17 and funnel 18. A phosphor screen 5 made up of phosphor layers of three colors for emitting blue, green, and red beams is formed on the inner surface of the panel 17. The panel 17 incorporates a shadow mask 19 having many electron beam apertures so as to face the phosphor screen 5.

The funnel 18 incorporates an in-line type electron gun assembly 22 in a neck 21. The electron gun assembly 22 emits three electron beams 8 (B, G, and R) in a line, i.e., a center beam 8G and a pair of side beams 8B and 8R that pass through the same horizontal plane. A deflection yoke 25 is mounted on the outer surface of the funnel 18 from a large-diameter portion 24 to the neck 21. The deflection yoke 25 forms a nonuniform magnetic field for converging three electron beams emitted by the electron gun assembly 22 toward the phosphor screen 5, and focusing the beams on the phosphor screen 5. The nonuniform magnetic field is formed from a pincushion type horizontal deflection magnetic field and barrel type vertical deflection magnetic field.

The three electron beams 8 (B, G, and R) emitted by the electron gun assembly 22 are deflected by the nonuniform magnetic field to vertically and horizontally scan the phosphor screen 5 through the shadow mask 19. Then, a color image is displayed.

Figure 7:
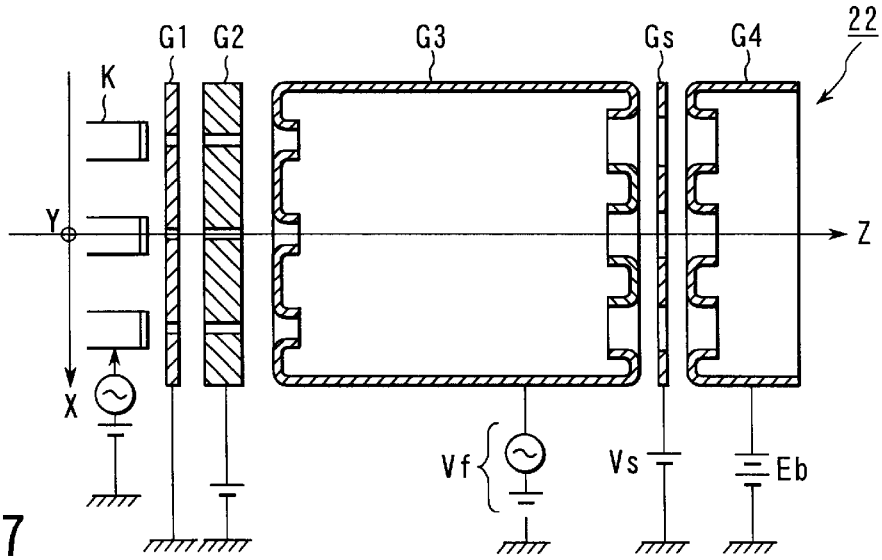
FIG. 7 is a sectional view showing the arrangement of an electron gun assembly according to the first embodiment applied to the color cathode ray tube apparatus shown in FIG. 6.

As shown in FIG. 7, the electron gun assembly 22 applied to the above-described color cathode ray tube apparatus has three cathodes K aligned in a line in Ail the horizontal direction (X), three heaters (not shown) for individually heating the cathodes K, a first grid G1, second grid G2, a third grid G3, an additional electrode Gs, and a fourth grid G4. These five electrodes are sequentially laid out from the cathode K to the phosphor screen. The heaters, cathodes K, and five electrodes are integrally fixed by a pair of insulator supports (not shown).

The first and second grids G1 and G2 are formed from plate-like electrodes. Each plate-like electrode has three electron beam apertures formed in a line in correspondence with the three cathodes K. The third grid G3 is formed from a cylindrical electrode. Each of the two end faces of the cylindrical electrode has three electron beam apertures formed in a line in correspondence with the three cathodes K. The fourth grid G4 is formed from a cup-like electrode. The end face of the cup-like electrode facing the third grid G3 has three electron beam apertures formed in a line in correspondence with the three cathodes K.

Figure 8:
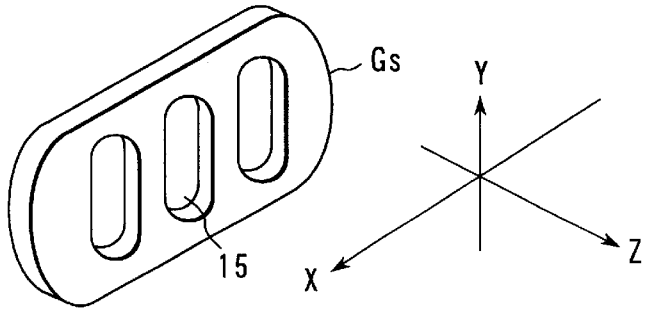
FIG. 8 is a perspective view showing the structure of an additional electrode applied to the electron gun assembly shown in FIG. 7.

The additional electrode Gs inserted between the third and fourth grids G3 and G4 is formed from a plate-like electrode. As shown in FIG. 8, the plate-like electrode has three electron beam apertures 15 formed in a line in correspondence with the three cathodes K. Each electron beam aperture 15 is formed into a vertically elongated uncircular shape having a larger diameter in the vertical direction (Y) than in the horizontal direction (X).

Figure 9A:
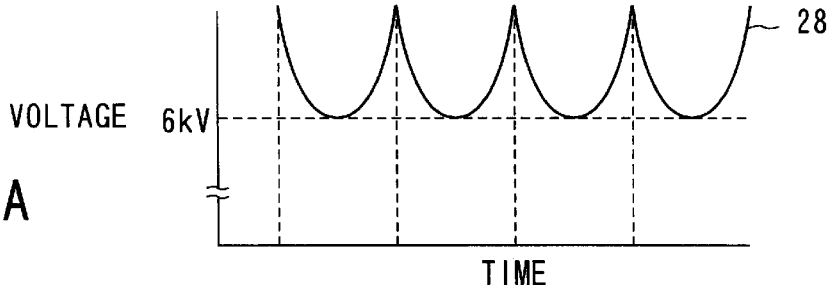
FIG. 9A is a graph showing a variable voltage applied to the focusing electrode of the electron gun assembly shown in FIG. 7.
Figure 9B:
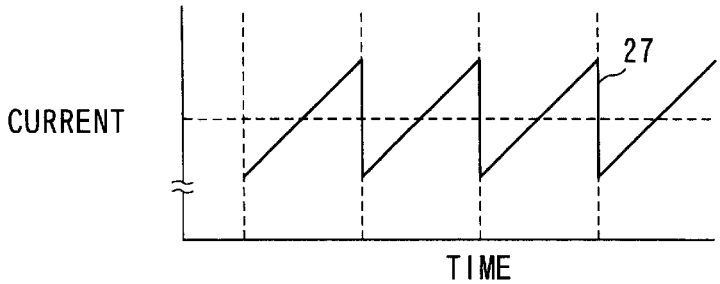
FIG. 9B is a graph showing a deflection current supplied to a deflection yoke.

The cathode K receives a voltage prepared by superposing a video signal on a DC voltage of 150 V. The first grid G1 is grounded. The second grid G2 receives a DC voltage of about 600 V. The third grid G3 receives a variable voltage 28 (Vf) prepared by superposing a parabolically changing voltage on a DC voltage of about 6 kV. As shown in FIGS. 9A and 9B, the variable voltage 28 increases in synchronism with a sawtooth-like deflection current 27 along with an increase in electron beam deflection amount. The additional electrode Gs receives a DC voltage (Vs) of about 16 kv. The fourth grid G4 receives a DC voltage (Eb) of about 26 kV.

The cathodes K, first grid G1, and second grid G2 constitute an electron beam generator for generating an electron beam and forming an object point with respect to a main lens (to be described later). The second and third grids G2 and G3 constitute a pre-focusing lens for preliminarily focusing the electron beam generated by the electron beam generator. The third grid G3 (focusing electrode), additional electrode Gs, and fourth grid G4 (anode electrode) constitute a BPF type main lens for finally focusing on the phosphor screen 5 the electron beam preliminarily focused by the pre-focusing lens. In deflecting the electron beam, the main lens internally forms a quadrupole lens. The lens power of the quadrupole lens dynamically changes with changes in electron beam deflection amount.

A method of forming the dynamically changing quadrupole lens in the main lens, and the action of the quadrupole lens will be described.

Figure 1:
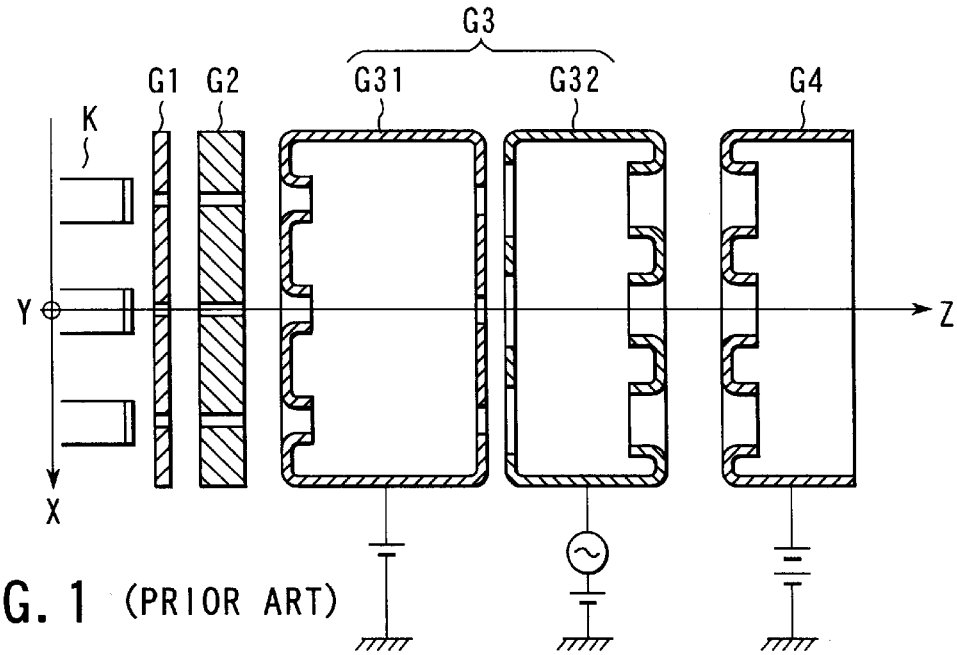
FIG. 1 (PRIOR ART)
FIG. 1 is a view showing the arrangement of a BPF DAC&F type electron gun assembly for a conventional color cathode ray tube apparatus.
Figure 2:
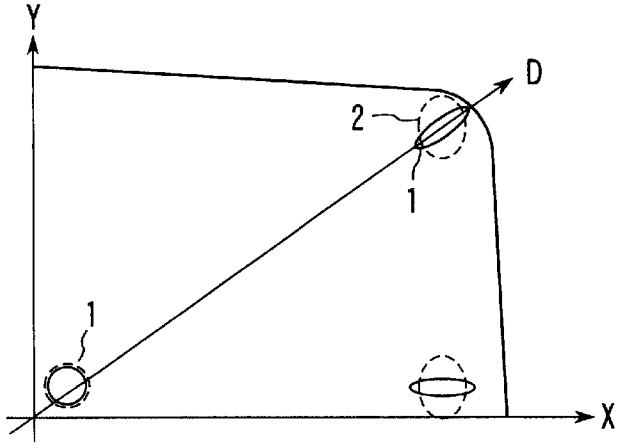
FIG. 2 (PRIOR ART)
FIG. 2 is a graph showing the shape of a beam spot on the phosphor screen of a conventional in-line type color cathode ray tube apparatus.
Figure 3:
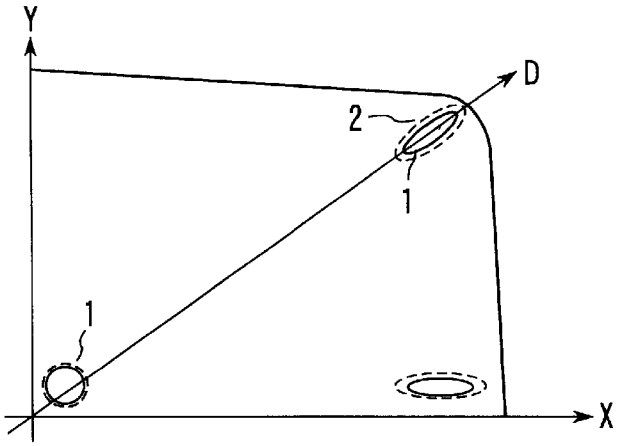
FIG. 3 (PRIOR ART)
FIG. 3 is a graph showing the shape of a beam spot on the phosphor screen of a color cathode ray tube apparatus having the electron gun assembly shown in FIG. 1.
Figure 4:
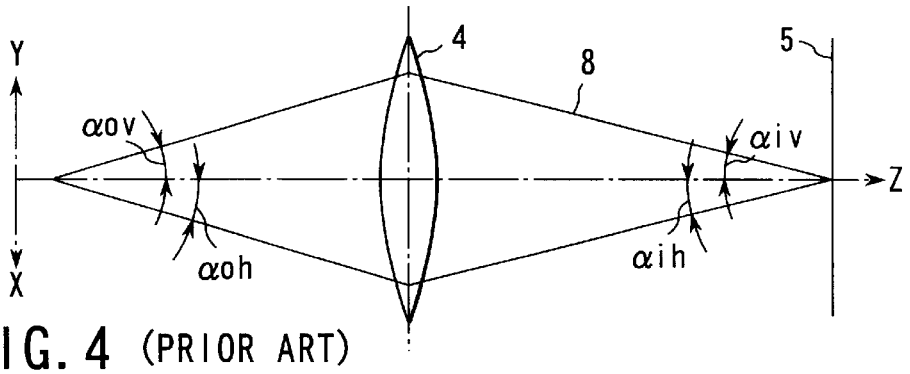
FIG. 4 (PRIOR ART)
FIG. 4 is a view showing an optical model in the no-deflection state of the color cathode ray tube apparatus having the electron gun assembly shown in FIG. 1.
Figure 10A:
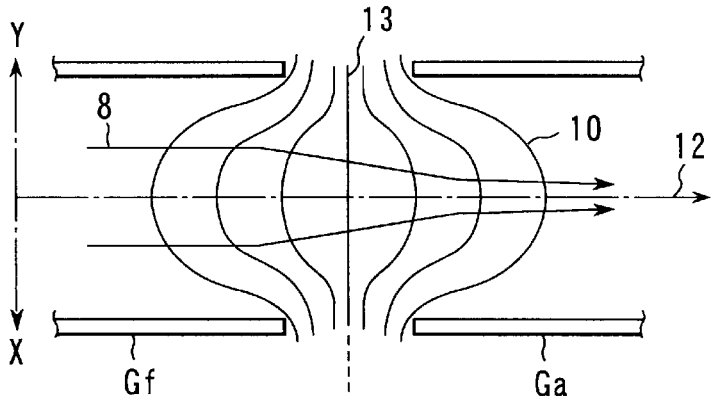
FIG. 10A is a view showing the horizontal and vertical electric fields of a rotation-symmetrical BPF type main lens.
Figure 10B:
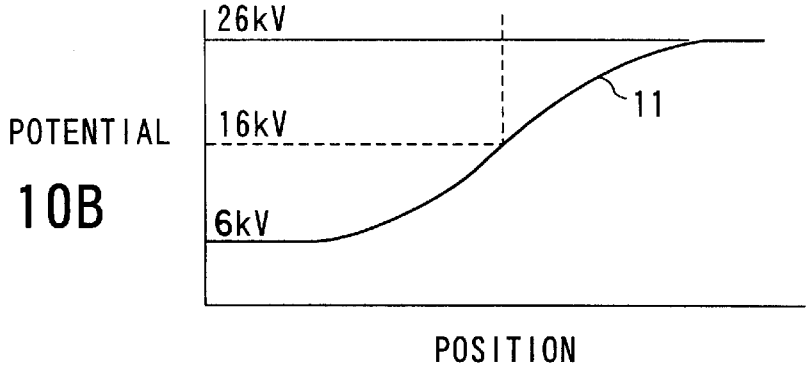
FIG. 10B is a graph showing a potential distribution on the central axis between the focusing electrode and anode electrode.

As shown in FIGS. 10A and 10B, the rotation-symmetrical BPF type main lens is formed by a potential difference between a focusing electrode Gf which receives 6 kV, and anode electrode Ga which receives 26 kV. As shown in FIG. 1A, the main lens forms an electric field symmetrical in the horizontal direction (X) and vertical direction (Y), like an equipotential plane 10, and gives the same focusing power to the electron beam 8 in both the horizontal and vertical directions. As shown in FIG. 10B, the main lens forms, on a central axis 12 between the focusing electrode Gf and anode electrode Ga, a potential distribution 11 in which the potential increases along the traveling direction of the electron beams 8. For the lens shown in FIGS. 10A and 10B, an equipotential plane 13 formed at the geometrical center of the main lens is flat, and the potential on this plane is 16 kV.

Figure 11A:
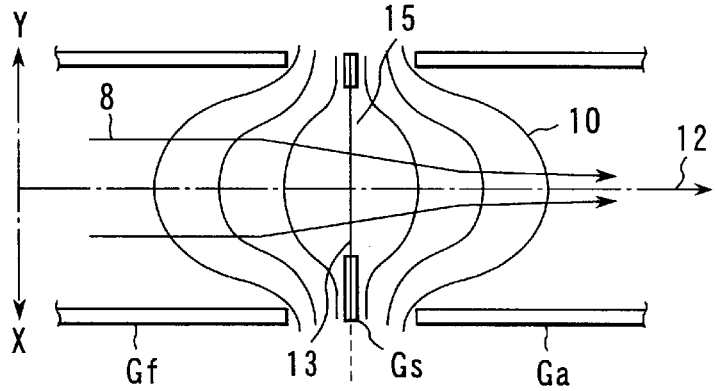
FIG. 11A is a view showing horizontal and vertical electric fields when the additional electrode is inserted in the rotation-symmetrical BPF type main lens.
Figure 11B:
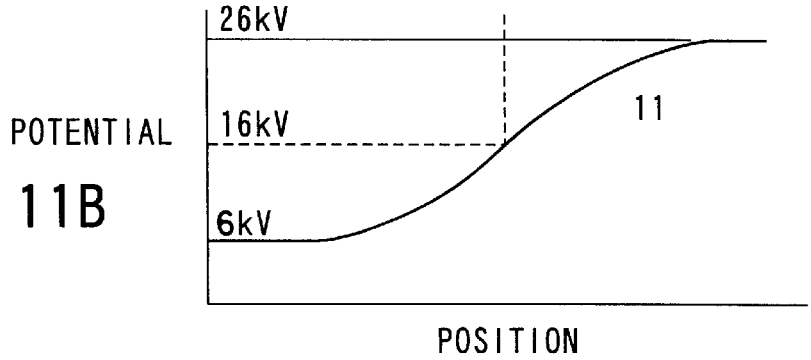
FIG. 11B is a graph showing a potential distribution on the central axis between the focusing electrode and anode electrode.

In the electron gun assembly 22 of the color cathode ray tube apparatus 1, as shown in FIG. 11A, the additional electrode Gs like the one shown in FIG. 8 is located at the geometrical center of the rotation-symmetrical BPF type main lens, i.e., the equipotential plane 13. As described above, the additional electrode Gs has the vertically elongated uncircular electron beam aperture 15 with a larger diameter in the vertical direction (Y) than in the horizontal direction (X). If the same potential as the equipotential plane 13, i.e., a potential of 16 kV is applied to the additional electrode Gs, the main lens obtains on the central axis 12 the same potential distribution 11 as that obtained when no additional electrode Gs is located, as shown in FIG. 11B. That is, the main lens shown in FIG. 11A forms the same distribution of the equipotential plane 10 as the main lens shown in FIG. 10A, and gives the same focusing power to the electron beam 8 in both the horizontal and vertical directions.

Figure 12A:
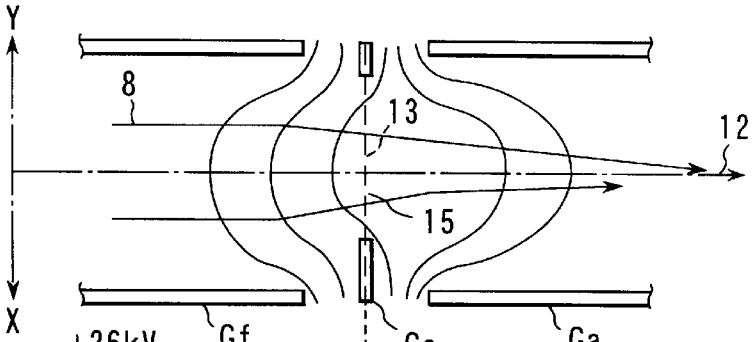
FIG. 12A is a view showing horizontal and vertical electric fields when the additional electrode is inserted in the rotation-symmetrical BPF type main lens and set to a different potential.
Figure 12B:
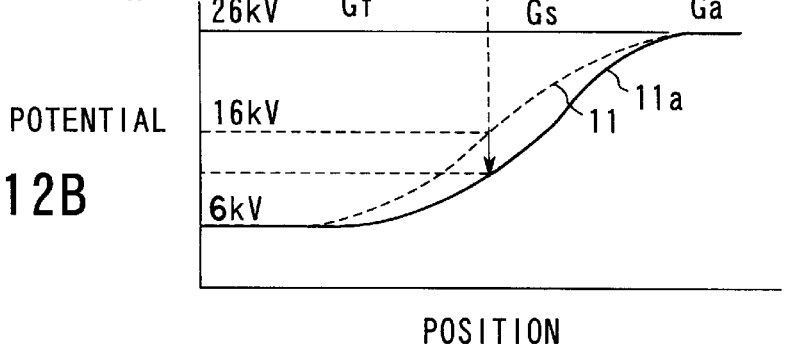
FIG. 12B is a graph showing a potential distribution on the central axis between the focusing electrode and anode electrode.

However, if a potential lower than the potential (16 kV) of the equipotential plane 13 is applied to the additional electrode Gs, the potential penetrates from the anode electrode Ga into the focusing electrode Gf through the electron beam aperture 15 of the additional electrode Gs to form an aperture lens, as shown in FIG. 12A. At this time, as shown in FIG. 12B, the main lens forms near the additional electrode Gs on the central axis 12 a potential distribution 11*a* lower than the potential distribution 11 shown in FIGS. 11A and 11B.

In the case in which a potential lower than that of the equipotential plane 13 is applied to the additional electrode Gs, the electron beam aperture 15 of the additional electrode Gs is vertically elongated, and thus the curvature in the horizontal direction (X) becomes smaller than in the vertical direction (Y) on the equipotential plane which penetrates into the focusing electrode Gf through the electron beam aperture 15. The focusing power of the main lens in the horizontal direction (X) becomes stronger than in the vertical direction (Y). As a result, the main lens attains astigmatism.

Figure 13A:
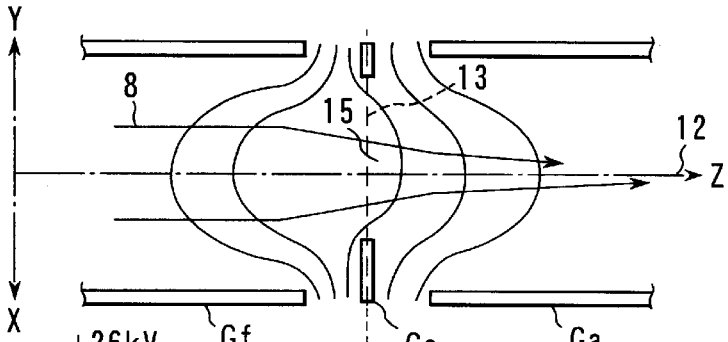
FIG. 13A is a view showing horizontal and vertical electric fields when the additional electrode is inserted in the rotation-symmetrical BPF type main lens and set to another different potential.
Figure 13B:
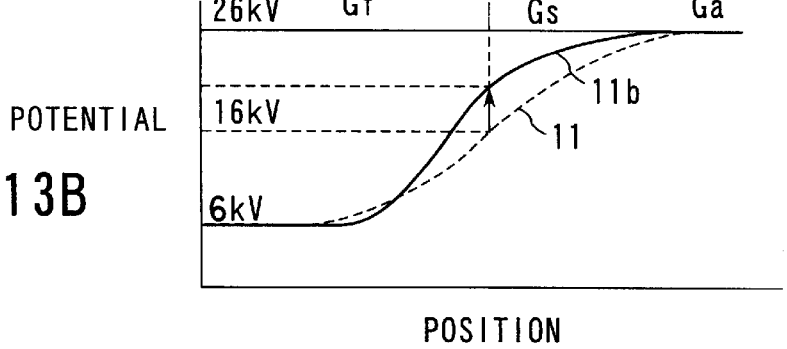
FIG. 13B is a graph showing a potential distribution on the central axis between the focusing electrode and anode electrode.

If a potential higher than the potential (16 kV) of the equipotential plane 13 is applied to the additional electrode Gs, the potential penetrates from the focusing electrode Gf into the anode electrode Ga through the electron beam aperture 15 of the additional electrode Gs to form an aperture lens, as shown in FIG. 13A. At this time, as shown in FIG. 13B, the main lens forms near the additional electrode Gs on the central axis 12 a potential distribution 11*b* higher than the potential distribution 11 shown in FIGS. 11A and 11B.

In the case in which a potential higher than that of the equipotential plane 13 is applied to the additional electrode Gs, the electron beam aperture 15 of the additional electrode Gs is vertically elongated, and thus the curvature in the horizontal direction (X) becomes smaller than in the vertical direction (Y) on the equipotential plane which penetrates into the anode electrode Ga through the electron beam aperture 15. The focusing power of the main lens in the horizontal direction (X) becomes weaker than in the vertical direction (Y). As a result, the main lens attains astigmatism reverse to that of the main lens shown in FIGS. 12A and 12B.

That is, in the BPF type main lens applied to the color cathode ray tube, the additional electrode Gs is inserted between the focusing electrode Gf and anode electrode Ga, and receives a predetermined potential. Hence, the main lens can attain astigmatism for adjusting the horizontal and vertical focusing powers without reducing the aperture.

In the above description, the astigmatism of the main lens is adjusted by changing the potential of the additional electrode. In general, letting Vf be the voltage of the focusing electrode, Eb be the voltage of the anode electrode, and Vs be the voltage of the additional electrode, the astigmatism can be similarly adjusted by changing $$(Vs-Vf)/(Eb-Vf).$$

In the electron gun assembly 22 according to the first embodiment shown in FIG. 7, the application voltage Vs of the additional electrode Gs and the application voltage Eb of the fourth grid G4 corresponding to the anode electrode Ga are fixed, whereas the application voltage Vf of the third grid G3 corresponding to the focusing electrode Gf is changed with changes in electron beam deflection amount, thereby changing $$(Vs-Vf)/(Eb-Vf).$$

In a no-deflection state, an electron beam generated by the electron beam generator is preliminarily focused by the pre-focusing lens made up of the second and third grids G2 and G3. The preliminarily focused electron beam is focused on the center of the phosphor screen by the main lens made up of the third grid G3, additional electrode Gs, and fourth grid G4. The main lens does not have any astigmatism, and gives the same focusing power to the electron beam in both the horizontal and vertical directions. Thus, the beam spot on the phosphor screen becomes almost circular.

In a deflection state, as the electron beam is deflected to the periphery of the phosphor screen, the application voltage Vf of the third grid G3 increases to decrease $$(Vs-Vf)/(Eb-Vf).$$

Since the additional electrode Gs has the vertically elongated electron beam aperture 15, the horizontal focusing power to the electron beam becomes stronger than the vertical focusing power. At the same time, the potential difference between the third and fourth grids G3 and G4 decreases to decrease the horizontal and vertical focusing powers to the electron beam.

The horizontal focusing power which is strengthened by the additional electrode Gs is set to cancel the horizontal focusing power which is weakened by a decrease in potential difference between the third and fourth grids G3 and G4. This arrangement can establish electron beam focusing conditions even at the periphery of the screen. The main lens having astigmatism can reduce the elliptic distortion of the beam spot at the periphery of the screen.

Figure 14:
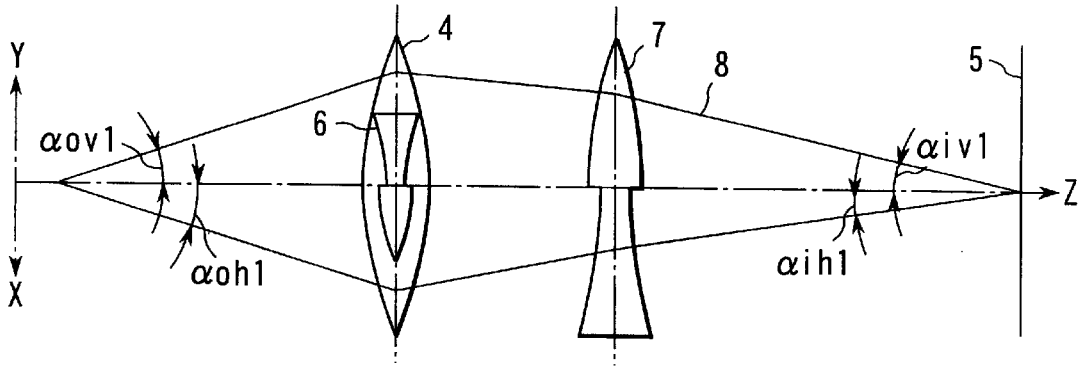
FIG. 14 is a view showing an optical model for explaining the basic arrangement of an electron gun assembly applied to a color cathode ray tube apparatus according to an embodiment of the present invention.

FIG. 14 is a view showing an optical model for explaining the action of the main lens in deflection.

In deflection, as shown in FIG. 14, a main lens 4 internally forms a quadrupole lens 6 having different horizontal and vertical focusing powers with respect to an electron beam 8 by changing the application voltage of the third grid G3 along with changes in deflection amount of the electron beams 8.

Letting $\alpha 0h1$ be a divergent angle in the horizontal direction (X), $\alpha ih1$ be an incident angle in the horizontal direction (X), $\alpha 0v1$ be a divergent angle in the vertical direction (Y), $\alpha iv1$ be an incident angle in the vertical direction (Y), a magnification Mh1 in the horizontal direction (X), and a magnification Mv1 in the vertical direction (Y), the magnifications Mh1 and Mv1 are given by $$Mh1=\alpha 0h1/\alpha ih1$$

$$Mv1=\alpha 0v1/\alpha iv1.$$

Figure 5:
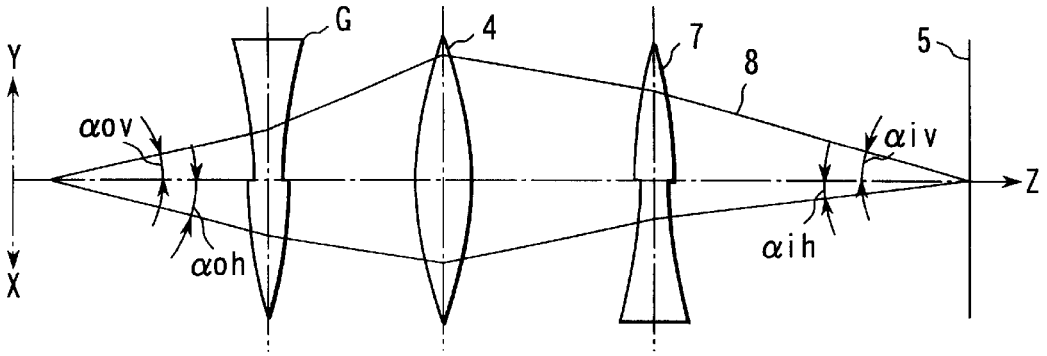
FIG. 5 (PRIOR ART)
FIG. 5 is a view showing an optical model in the deflection state of the color cathode ray tube apparatus having the electron gun assembly shown in FIG. 1.

The quadrupole lens 6 formed inside the main lens 4 is formed closer to a quadrupole lens 7 formed by a deflection magnetic field than a quadrupole lens 6 formed in front of the main lens 4 as shown in FIG. 5.

If $$\alpha 0h=\alpha 0h1$$

$$\alpha 0v=\alpha 0v1$$

the incident angles satisfy $$\alpha ih<\alpha ih1$$

$$\alpha iv>\alpha iv1$$

This results in $$Mh1<\mathrm{Mh}$$

$$Mv1>\mathrm{Mv}.$$

As shown in FIG. 5, in the conventional electron gun assembly, the horizontal and vertical magnifications Mh and Mv given by $$Mh=\alpha 0h/\alpha ih$$

$$Mv=\alpha 0v/\alpha iv.$$

have a relation:

$$\alpha ih<\alpha iv$$

because at the periphery of the screen $$Mh>Mv.$$

As a result, the beam spot elliptically distorts.

To the contrary, in the electron gun assembly according to the first embodiment, $\alpha ih1$ can be made larger than $\alpha ih$, and $\alpha iv1$ can be made smaller than $\alpha iv$. This results in $$Mh1<Mh$$

$$Mh1>Mv.$$

Figure 15:
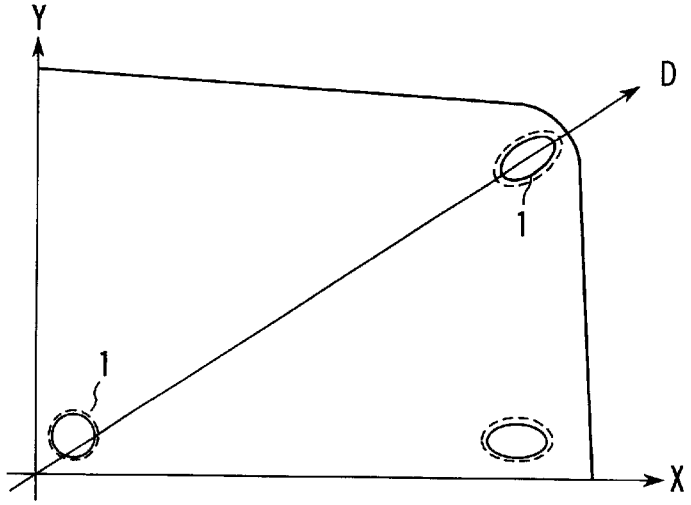
FIG. 15 is a graph for explaining reduction of the elliptic distortion of a beam spot on the phosphor screen by the electron gun assembly shown in FIG. 14.

For this reason, the difference between the horizontal and vertical magnifications Mh and Mv can be reduced. As shown in FIG. 15, the elliptic distortion of a beam spot 1 can be reduced at the periphery of the screen extending from the end of the horizontal axis (X) to the end of the diagonal axis (D).

When the main lens made up of the third grid, additional electrode Gs, and fourth grid G4 has a stronger horizontal focusing power than the vertical focusing power, the application voltage of the additional electrode Gs is set lower than the potential of the equipotential plane 13 corresponding to the layout position of the additional electrode Gs in a no-deflection state, thereby obtaining the same effects as described above. Alternatively, a parabolic variable voltage which increases with an increase in deflection amount is applied to the third grid G3 to decrease $$(Vs-Vf)/(Eb-Vf).$$

The horizontal focusing power which is strengthened by the additional electrode Gs is set to cancel the horizontal focusing power which is weakened by a decrease in potential difference between the third and fourth grids G3 and G4. This arrangement can realize a color cathode ray tube apparatus having the same effects as described above.

The arrangement of an electron gun assembly according to the second embodiment will be described.

Figure 16:
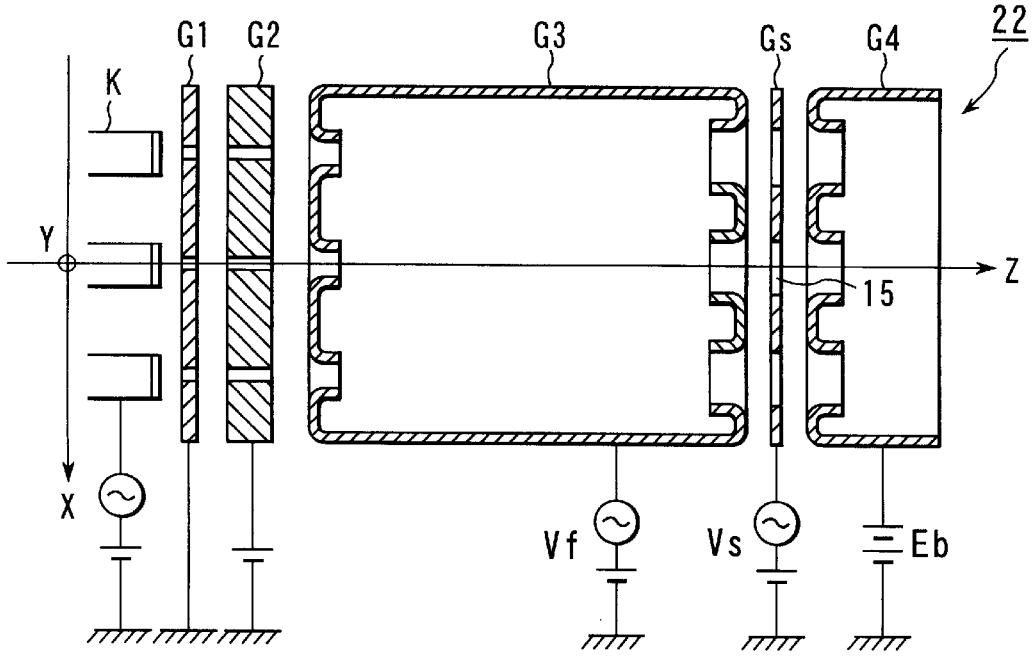
FIG. 16 is a sectional view showing the arrangement of an electron gun assembly according to the second embodiment applied to the color cathode ray tube apparatus shown in FIG. 6.

As shown in FIG. 16, an electron gun assembly 22 according to the second embodiment has almost the same arrangement as that of the electron gun assembly shown in FIG. 7. A detailed description of the electron gun assembly 22 will be omitted, and only a different part will be described.

Figure 17:
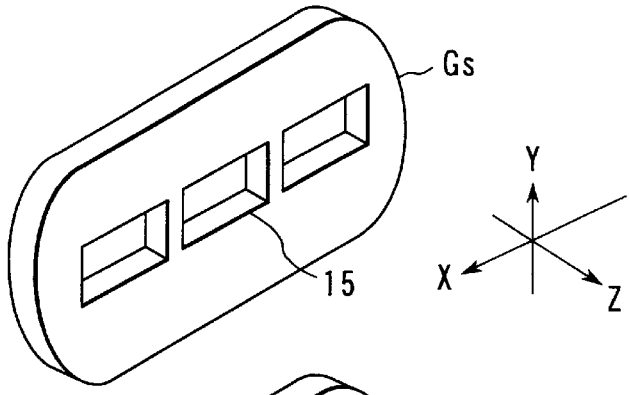
FIG. 17 is a perspective view showing the structure of an additional electrode applied to the electron gun assembly shown in FIG. 16.
Figure 18:
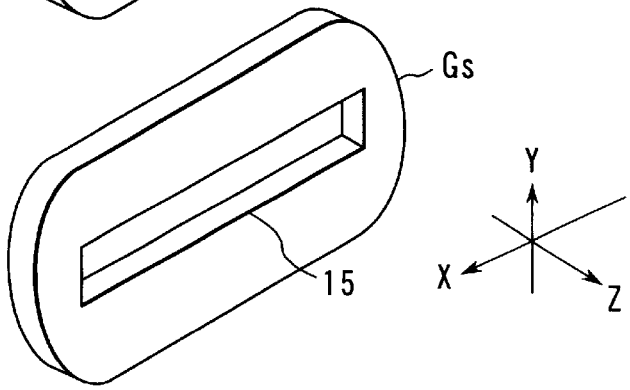
FIG. 18 is a perspective view showing the structure of another additional electrode applied to the electron gun assembly shown in FIG. 16.
Figure 19A:
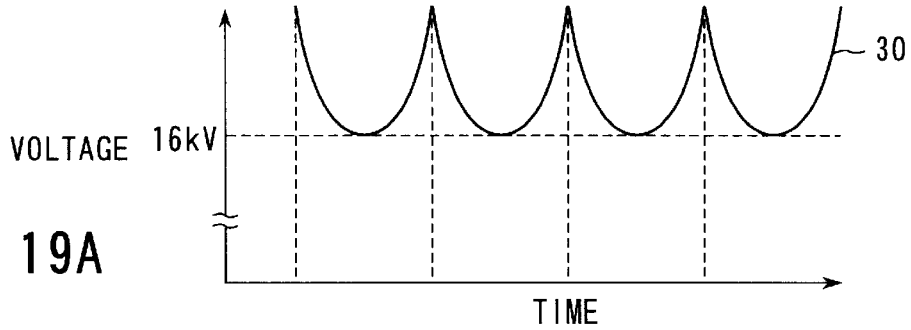
FIG. 19A is a graph showing a variable voltage applied to the additional electrode of the electron gun assembly shown in FIG. 16.
Figure 19B:
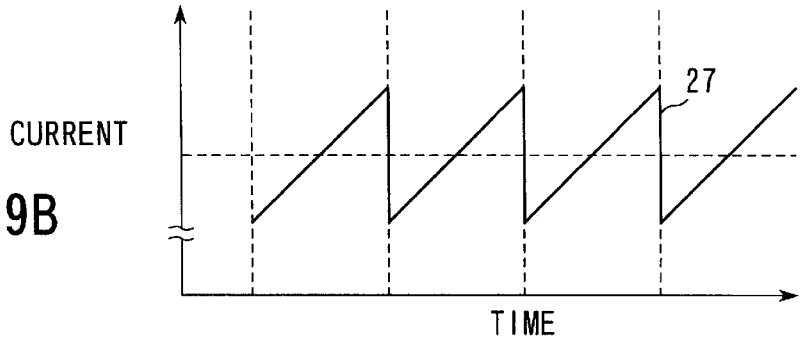
FIG. 19B is a graph showing a deflection current supplied to the deflection yoke.

As shown in FIG. 17 or 18, an additional electrode Gs has three or one horizontally elongated uncircular electron beam aperture 15 with a larger diameter in the horizontal direction (X) than in the vertical direction (Y). As shown in FIG. 19A, the additional electrode Gs receives a variable voltage 30 (Vs) prepared by superposing a parabolically changing voltage on a DC voltage of about 16 kV. As shown in FIGS. 19A and 19B, this parabolic voltage increases in synchronism with a sawtooth-like deflection current 27 along with an increase in electron beam deflection amount. The parabolic variable voltage 30 has almost the same amplitude as a variable voltage 28 applied to a third grid G3 like the one shown in FIG. 9A.

Also with this arrangement, in a no-deflection state, an electron beam preliminarily focused by a pre-focusing lens is focused on the center of the phosphor screen by the main lens. The main lens does not have any astigmatism, and gives the same focusing power to the electron beam in both the horizontal and vertical directions. Thus, the beam spot on the phosphor screen becomes almost circular, as shown in FIG. 15.

In a deflection state, as the electron beam is deflected to the periphery of the phosphor screen, the application voltage Vf of the third grid G3 increases. In synchronism with this, as the electron beam is deflected to the periphery of the phosphor screen, the application voltage Vs of the additional electrode Gs increases to increase $$(Vs-Vf)/(Eb-Vf).$$

Since the additional electrode Gs has the horizontally elongated electron beam aperture 15, the horizontal focusing power to the electron beam becomes stronger than the vertical focusing power. At the same time, the potential difference between the third grid G3 and a fourth grid G4 decreases to simultaneously decrease the horizontal and vertical focusing powers to the electron beam.

The horizontal focusing power which is strengthened by the additional electrode Gs is set to cancel the horizontal focusing power which is weakened by a decrease in potential difference between the third and fourth grids G3 and G4. This arrangement can establish electron beam focusing conditions even at the periphery of the screen. The main lens having astigmatism can reduce the elliptic distortion of a beam spot at the periphery of the screen, as shown in FIG. 15.

When the main lens made up of the third grid, additional electrode Gs, and fourth grid G4 has a stronger horizontal focusing power than the vertical focusing power, the application voltage of the additional electrode Gs is set higher than the potential of an equipotential plane 14 corresponding to the layout position of the additional electrode Gs in a no-deflection state, thereby obtaining the same effects as described above. Alternatively, a parabolic variable voltage which increases with an increase in deflection amount is applied to the third grid G3 to increase $$(Vs-Vf)/(Eb-Vf).$$

The horizontal focusing power which is strengthened by the additional electrode Gs is set to cancel the horizontal focusing power which is weakened by a decrease in potential difference between the third and fourth grids G3 and G4. This arrangement can realize a color cathode ray tube apparatus having the same effects as described above.

As described above, at least one additional electrode is inserted between the focusing electrode and anode electrode forming the main lens for finally focusing an electron beam on the phosphor screen. This main lens is given astigmatism which dynamically changes. This arrangement can constitute a color cathode ray tube apparatus which can reduce the elliptic distortion of a beam spot on the entire screen, and displays a high-quality image.

The arrangement of an electron gun assembly according to the third embodiment will be described.

In the electron gun assembly according to the first and second embodiments, the beam spot focused on the center of the phosphor screen is made circular, and the elliptic distortion of a beam spot focused on the periphery can be reduced. The electron gun assembly according to the third embodiment can further reduce the elliptic distortion of the beam spot at the periphery.

The electron gun assembly according to the third embodiment comprises two quadrupole lenses.

For example, in a double quadrupole lens type electron gun assembly having a third grid made up of three segments, first and second quadrupole lenses are formed in front of the main lens. The first quadrupole lens is formed between the first and second segments, and has horizontal divergent action and vertical convergent action. The second quadrupole lens is formed between the second and third segments, and has horizontal convergent action and vertical divergent action.

In the theory of magnification, this double quadrupole lens type electron gun assembly can form a circular beam spot on the entire phosphor screen. In practice, however, a vertical diameter Ssv of the beam spot is increased, but a horizontal diameter Ssh is not decreased, and the average diameter ((Ssv+Ssh)/2) of the beam spot is increased. Consequently, the beam spot on the screen enlarges to degrade the image quality.

In the double quadrupole lens type electron gun assembly, the electron beam is greatly influenced by aberrations contained in the first and second quadrupole lenses, and thus the horizontal diameter of the beam spot on the screen cannot be satisfactorily reduced. This also results from a large diameter of an electron beam incident on the main lens and a large influence of spherical aberration contained in the main lens.

For this reason, the electron gun assembly according to the third embodiment adopts the double quadrupole lens scheme in which the first quadrupole lens is formed in front of the main lens and the second quadrupole lens is formed at the center of the main lens. This electron gun assembly basically eliminates the difference between the horizontal and vertical magnifications Mh and Mv, and reduces the aberrations of the quadrupole lens and main lens.

Figure 20:
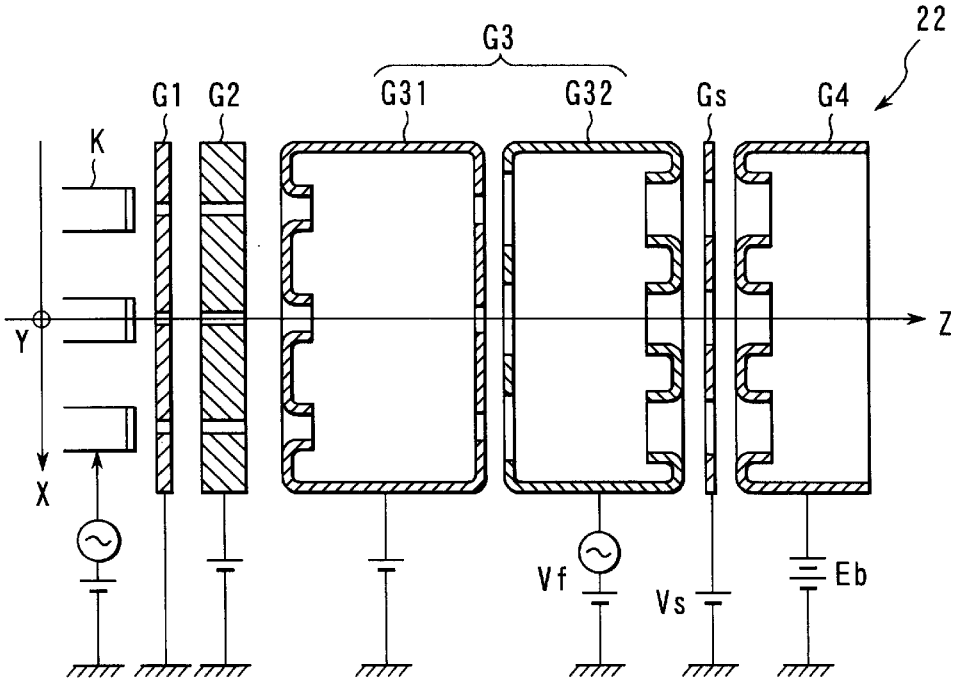
FIG. 20 is a sectional view showing the arrangement of an electron gun assembly according to the third embodiment applied to the color cathode ray tube apparatus shown in FIG. 6.

More specifically, as shown in FIG. 20, an electron gun assembly 22 according to the third embodiment has almost the same arrangement as that of the electron gun assembly shown in FIG. 7. A detailed description of the electron gun assembly 22 will be omitted, and only a different part will be described.

A third grid G3 has a first segment G31 adjacent to a second grid G2, and a second segment G32 adjacent to an additional electrode Gs. The first and second segments G31 and G32 are formed from cylindrical electrodes.

Each of the two end faces of each cylindrical electrode has three cathodes K aligned in a line in correspondence with three cathodes K. The three electron beam apertures of the first segment G31 formed on the second segment G32 side have a vertically elongated uncircular shape with a larger vertical diameter than the horizontal diameter. The three electron beam apertures of the second segment G32 formed on the first segment G31 side have a horizontally elongated uncircular shape with a larger horizontal diameter than the vertical diameter.

The additional electrode Gs is formed from a plate-like electrode inserted between the second segment G32 and a fourth grid G4. This plate-like electrode has three vertically elongated uncircular electron beam apertures 15, as shown in FIG. 8.

The first segment G31 of the third grid G3 receives a DC voltage of about 6 kV. The second segment G32 receives a variable voltage 28 (Vf) like the one shown in FIG. 9A. The additional electrode Gs receives a DC voltage (Vs) of about 16 kV.

In a no-deflection state, the first and second segments G31 and G32 of the third grid G3 have the same potential, and do not form any electron lens between them. The main lens made up of the second segment G32, additional electrode Gs, and fourth grid G4 does not have any astigmatism, i.e., any quadrupole lens action. Therefore, an electron beam emitted by the electron beam generator is preliminarily focused by the prefocusing lens, passes through the first segment G31, and is focused on the center of the phosphor screen by the main lens. The main lens does not have any astigmatism, and gives the same focusing power to the electron beam in both the horizontal and vertical directions. Thus, the beam spot on the phosphor screen becomes almost circular, as shown in FIG. 15.

In a deflection state, the first and second Ace segments G31 and G32 form the first quadrupole lens between them. The first quadrupole lens gives horizontal divergent action and vertical convergent action to the electron beam. The second segment G32, additional electrode Gs, and fourth grid G4 form a main lens incorporating the second quadrupole lens. Since the application voltage Vf of the second segment G32 is higher than that in a no-deflection state, the second quadrupole lens decreases $$(Vs-Vf)/(Eb-Vf).$$

In addition, the vertically elongated uncircular electron beam aperture 15 formed in the additional electrode Gs gives horizontal convergent action and vertical divergent action to the electron beam. Since the voltage difference (Eb−Vf) between the second segment G32 and fourth grid G4 decreases, the horizontal convergent action and vertical divergent action simultaneously decrease.

A decrease in focusing power caused by a decrease in voltage difference (Eb−vf) between the second segment G32 and fourth grid G4 is set to cancel divergent action generated by the first and second segments G31 and G32. This establishes electron beam focusing conditions even at the periphery of the phosphor screen.

For this reason, the difference between the horizontal and vertical magnifications of a beam spot formed at the periphery of the phosphor screen is eliminated. Further, the aberration of the first quadrupole lens formed between the first and second segments G31 and G32 and the aberration of the second quadrupole lens formed in the main lens can be reduced. By decreasing the diameter of an electron beam incident on the main lens, the spherical aberration of the main lens can be reduced. This can reduce the elliptic distortion of the beam spot at the periphery of the phosphor screen.

The action of the double quadrupole lens type electron gun assembly will be explained in detail with reference to an optical model like the one shown in FIG. 21.

Figure 21:
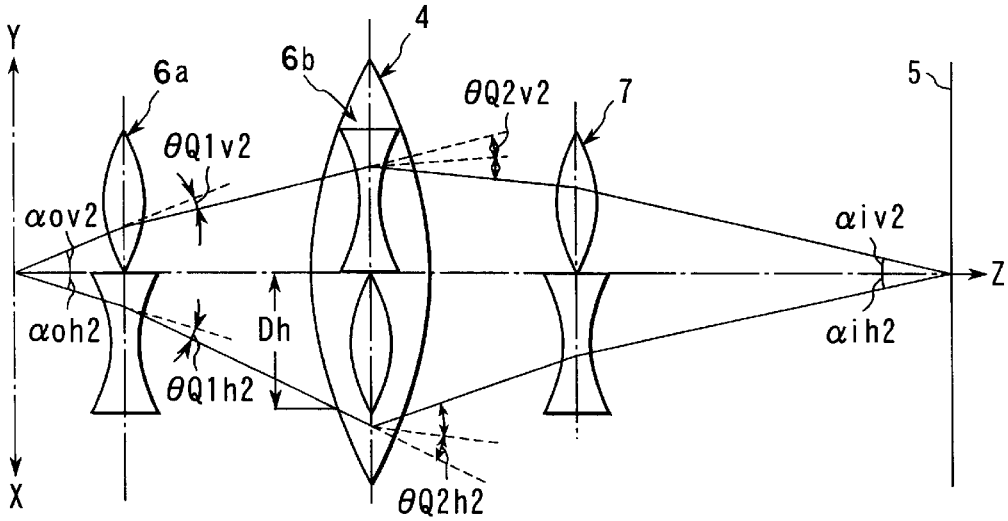
FIG. 21 is a view showing an optical model for explaining the basic arrangement of a double quadrupole lens type electron gun assembly applied to a color cathode ray tube apparatus according to an embodiment of the present invention.

As shown in FIG. 21, the double quadrupole lens type electron gun assembly has a first quadrupole lens 6*a* in front of a main lens 4, and forms a second quadrupole lens 6*b* inside the main lens 4. In this case, letting Mh2 be the horizontal magnification, Mv2 be the vertical magnification, α0h2 be the horizontal divergent angle, αih2 be the horizontal incident angle, α0v2 be the vertical divergent angle, and αiv2 be the vertical incident angle, the horizontal and vertical magnifications Mh2 and Mv2 are given by $$Mh2=\alpha 0h2/\alpha ih2$$

$$Mv2=\alpha 0v2/\alpha iv2.$$

Since $$\alpha ih2=\alpha iv2$$

the horizontal and vertical magnifications Mh2 and Mv2 satisfy $$Mh2=Mv2.$$

The difference between the horizontal and vertical magnifications can be eliminated. By forming the second quadrupole lens 6*b* at the center of the main lens 4, the interval between the first and second quadrupole lenses 6*a* and 6*b* can be set large. Horizontal divergent angles θQ1h2 and θQ2h2 and vertical divergent angles θQ1v2 and θQ2v2 of the first and second quadrupole lenses 6*a* and 6*b* become smaller than those obtained when the first and second quadrupole lenses are arranged in front of the main lens. Hence, the aberrations of the first and second quadrupole lenses 6*a* and 6*b* can be reduced.

By forming the second quadrupole lens 6*b* at the center of the main lens 4, a diameter Dh2 of an electron beam incident on the main lens becomes smaller than that obtained when the first and second quadrupole lenses are located in front of the main lens. The spherical aberration of the main lens can therefore be reduced.

This arrangement can eliminate the difference between the horizontal and vertical magnifications caused when the electron beam is deflected to the periphery of a phosphor screen 5, thereby reducing the aberration of the quadrupole lens and the spherical aberration of the main lens. Thus, the distortion of a beam spot 1 can be reduced on the entire phosphor screen.

A double quadrupole lens type electron gun assembly according to the fourth embodiment will be described.

Figure 23:
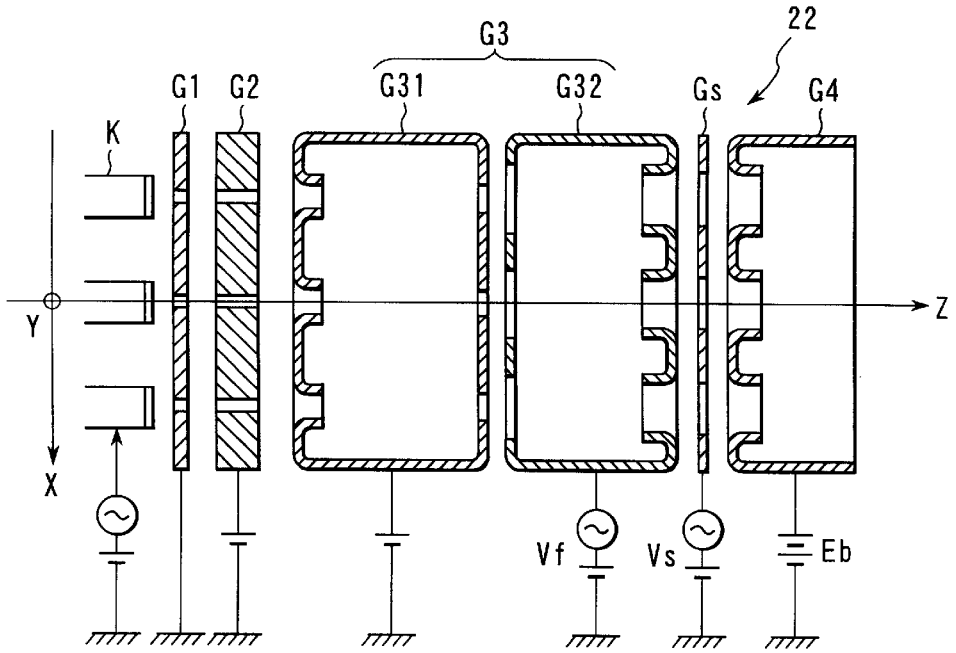
FIG. 23 is a sectional view showing the arrangement of an electron gun assembly according to the fourth embodiment applied to the color cathode ray tube apparatus shown in FIG. 6.

As shown in FIG. 23, an electron gun assembly 22 according to the fourth embodiment has almost the same arrangement as that of the electron gun assembly according to the third embodiment shown in FIG. 20. A detailed description of the electron gun assembly 22 will be omitted, and only a different part will be described.

As shown in FIGS. 17 and 18, an additional electrode Gs has three or one horizontally elongated uncircular electron beam aperture 15 with a larger diameter in the horizontal direction (X) than in the vertical direction (Y).

As shown in FIG. 19A, the additional electrode Gs receives a variable voltage 30 (Vs) prepared by superposing a parabolically changing voltage on a DC voltage of about 16 kV. As shown in FIGS. 19A and 19B, this parabolic voltage increases in synchronism with a sawtooth-like deflection current 27 along with an increase in electron beam deflection amount. The parabolic variable voltage 30 has almost the same amplitude as a variable voltage 28 applied to a third grid G3 like the one shown in FIG. 9A.

Figure 22:
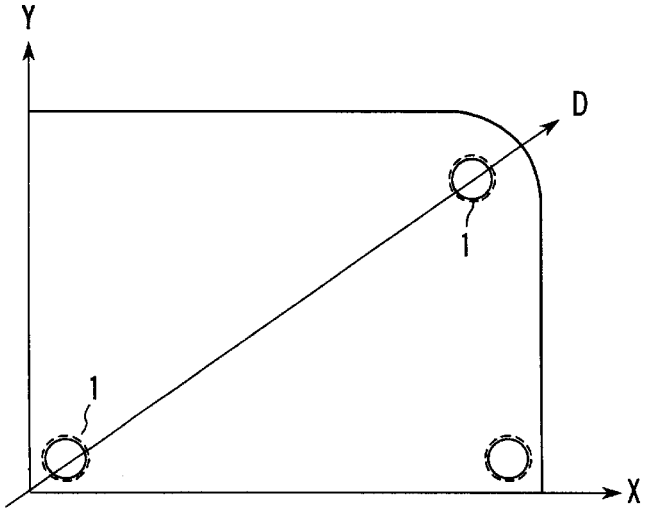
FIG. 22 is a graph for explaining reduction of the elliptic distortion of a beam spot on the phosphor screen by the electron gun assembly shown in FIG. 21.

Also with this arrangement, in a no-deflection state, first and second segments G31 and G32 have the same potential, and do not form any electron lens between them. The main lens made up of the second segment G32, the additional electrode Gs, and a fourth grid G4 does not have any astigmatism, i.e., any quadrupole lens action. Therefore, an electron beam preliminarily focused by the pre-focusing lens is focused on the center of the phosphor screen by the main lens. The main lens gives the same focusing power to the electron beam in both the horizontal and vertical directions. Thus, the beam spot on the phosphor screen becomes almost circular, as shown in FIG. 22.

In a deflection state, as the electron beam is deflected to the periphery of the phosphor screen, the application voltage Vf of the third grid G3 increases. In synchronism with this, as the electron beam is deflected to the periphery of the phosphor screen, the application voltage Vs of the additional electrode Gs also increases. This increases $$(Vs-Vf)/(Eb-Vf).$$

The additional electrode Gs having the horizontally elongated electron beam aperture 15 gives horizontal convergent action and vertical divergent action to the electron beam. Since the voltage difference (Eb−Vf) between the second segment G32 and fourth grid G4 decreases, the horizontal convergent action and vertical divergent action to the electron beam simultaneously decrease.

As a result, the fourth embodiment can attain the same effects as those of the third embodiment.

A double quadrupole lens type electron gun assembly according to the fifth embodiment will be described.

Figure 24:
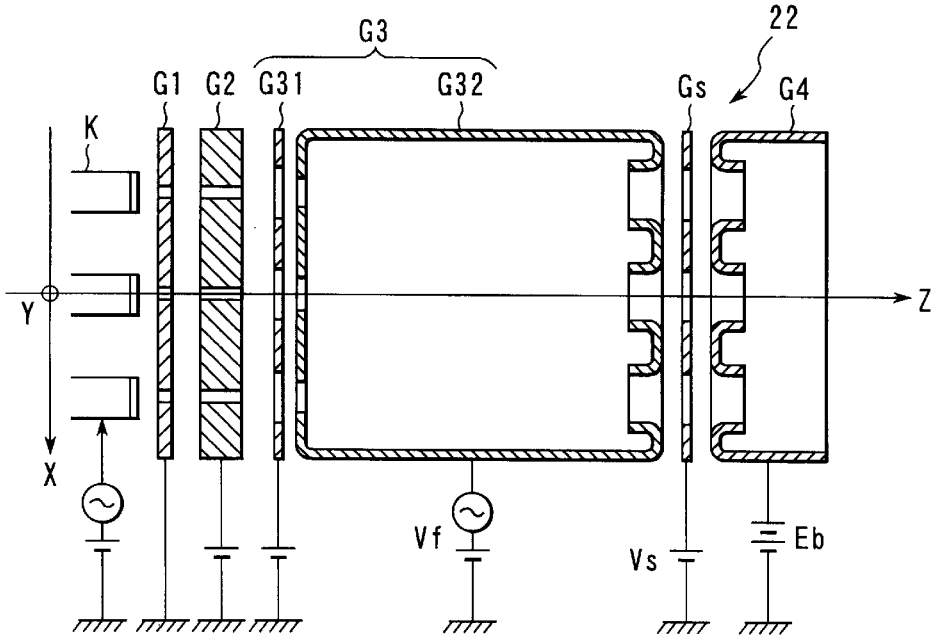
FIG. 24 is a sectional view showing the arrangement of an electron gun assembly according to the fifth embodiment applied to the color cathode ray tube apparatus shown in FIG. 6.

As shown in FIG. 24, an electron gun assembly 22 according to the fifth embodiment has almost the same arrangement as that of the electron gun assembly according to the third embodiment shown in FIG. 20. A detailed description of the electron gun assembly 22 will be omitted, and only a different part will be described.

As shown in FIG. 24, the electron gun assembly 22 has a third grid G3 made up of a first plate-like segment G31 and second cylindrical segment G32. The first segment G31 is located on a second grid G2 side, whereas the second segment G32 is located on an additional electrode Gs side.

As shown in FIG. 17, the first segment G31 has three horizontally elongated uncircular electron beam apertures 15 with a larger diameter in the horizontal direction (X) than in the vertical direction (Y). The second segment G32 has, on the first segment G31 side, three vertically elongated uncircular electron beam apertures 15 with a larger diameter in the vertical direction (Y) than in the horizontal direction (X).

As shown in FIG. 8, the additional electrode Gs inserted between the second segment G32 and a fourth grid G4 has three vertically elongated uncircular electron beam apertures 15 with a larger diameter in the vertical direction (Y) than in the horizontal direction (X).

The first segment G31 of the third grid G3 receives a predetermined DC voltage, and the second segment G32 receives a variable voltage 28 (Vf). The additional electrode Gs receives a predetermined voltage (Vs).

In a no-deflection state, the electron gun assembly 22 having this arrangement can form a pre-focusing lens free from any astigmatism. In a deflection state, the pre-focusing lens can be given a quadrupole lens effective by applying to the second segment G32 a variable voltage which varies in an increase in electron beam deflection amount.

The fifth embodiment can therefore obtain the same effects as those of the third embodiment.

Industrial Applicability

As described above, the electron gun assembly adopts the double quadrupole lens scheme. In deflection, one quadrupole lens is formed in front of the main lens, and the other is formed inside the main lens. This can constitute a color cathode ray tube apparatus which can reduce the elliptic distortion of a beam spot without enlarging the beam spot, and displays a high-quality image on the entire screen.

What is claimed is:

1. A color cathode ray tube apparatus characterized by comprising an electron gun assembly having a main lens which is made up of at least a focusing electrode and anode electrode, and accelerates and focuses an electron beam on a phosphor screen, and a deflection yoke for generating a deflection magnetic field for deflecting the electron beam emitted by said electron gun assembly, wherein said electron gun assembly has at least one additional electrode located along an equipotential plane of a potential distribution formed between the focusing electrode and anode electrode forming the main lens, in a no-deflection state in which the electron beam is focused on a center of the phosphor screen, the additional electrode receives a voltage of a predetermined level corresponding to a potential of the equipotential plane on which the additional electrode is located, and in a deflection state in which the electron beam is deflected to a periphery of the phosphor screen, letting Vf be an application voltage of the focusing electrode, Eb be an application voltage of the anode electrode, and Vs be an application voltage of the additional electrode, a value $$(Vs-Vf)/(Eb-Vf)$$

changes with an increase in electron beam deflection amount, while the additional electrode forms an electron lens having different horizontal and vertical focusing powers.

2. An apparatus according to claim 1, characterized in that the voltage applied to the focusing electrode dynamically changes with an increase in electron beam deflection amount.

3. An apparatus according to claim 1, characterized in that a vertical focusing power of the main lens becomes weaker than a horizontal focusing power along with an increase in electron beam deflection amount.

4. An apparatus according to claim 1, characterized in that the additional electrode is formed from a plate-like electrode having an uncircular electron beam aperture using a vertical direction as a major axis, and the value $$(Vs-Vf)/(Eb-Vf)$$

changes in synchronism with a deflection current supplied to said deflection yoke and decreases with an increase in electron beam deflection amount.

5. An apparatus according to claim 1, characterized in that the voltage applied to the additional electrode dynamically changes with an increase in electron beam deflection amount.

6. An apparatus according to claim 1, characterized in that the additional electrode is formed from a plate-like electrode having an uncircular electron beam aperture using a horizontal direction as a major axis, and the value $$(Vs-Vf)/(Eb-Vf)$$

changes in synchronism with a deflection current supplied to said deflection yoke and increases with an increase in electron beam deflection amount.

7. An apparatus according to claim 1, characterized by further comprising:

at least one multipole lens which acts on an electron beam before being incident on the main lens; and voltage application means for applying a voltage so as to dynamically change focusing powers of the main lens and at least one multipole lens in synchronism with a deflection current supplied to said deflection yoke.

8. An apparatus according to claim 7, characterized in that the main lens has a relatively strong horizontal focusing power and relatively weak vertical focusing power along with an increase in electron beam deflection amount, and the multipole lens has a relatively weak horizontal focusing power and relatively strong vertical focusing power along with an increase in electron beam deflection amount.

9. An apparatus according to claim 7, characterized in that the voltage applied to the focusing electrode dynamically changes with an increase in electron beam deflection amount.

10. An apparatus according to claim 7, characterized in that the additional electrode is formed from a plate-like electrode having an uncircular electron beam aperture using a vertical direction as a major axis, and the value $$(Vs-Vf)/(Eb-Vf)$$

changes in synchronism with a deflection current supplied to said deflection yoke and decreases with an increase in electron beam deflection amount.

11. An apparatus according to claim 7, characterized in that the voltage applied to the additional electrode dynamically changes with an increase in electron beam deflection amount.

12. An apparatus according to claim 7, characterized in that the additional electrode is formed from a plate-like electrode having an uncircular electron beam aperture using a horizontal direction as a major axis, and the value $$(Vs-Vf)/(Eb-Vf)$$

changes in synchronism with a deflection current supplied to said deflection yoke and increases with an increase in electron beam deflection amount.

13. An apparatus according to claim 7, characterized in that said electron gun assembly has a pre-focusing lens for preliminarily focusing the electron beam incident on the main lens, and said multipole lens is formed inside the pre-focusing lens.

14. A color cathode ray tube apparatus characterized by comprising an electron gun assembly having a main lens which is made up of at least a focusing electrode and anode electrode, and accelerates and focuses an electron beam on a phosphor screen, and a deflection yoke for generating a deflection magnetic field for deflecting the electron beam emitted by said electron gun assembly, wherein said electron gun assembly has at least one additional electrode located along an equipotential plane of a potential distribution formed between the focusing electrode and anode electrode forming the main lens, in a predetermined deflection state in which the electron beam is deflected, the additional electrode receives a voltage of a predetermined level corresponding to a potential of the equipotential plane on which the additional electrode is located, and in a deflection state in which the electron beam is deflected to a periphery of the phosphor screen, letting Vf be an application voltage of the focusing electrode, Eb be an application voltage of the anode electrode, and Vs be an application voltage of the additional electrode, a value $$(Vs-Vf)/(Eb-Vf)$$

changes with an increase in electron beam deflection amount, while the additional electrode forms an electron lens having different horizontal and vertical focusing powers.

* * * * *